US005687682A

United States Patent [19]

Rembold et al.

[11] Patent Number: 5,687,682

[45] Date of Patent: Nov. 18, 1997

[54] METHOD AND APPARATUS FOR STARTING AN INTERNAL COMBUSTION ENGINE

[75] Inventors: Helmut Rembold, Stuttgart; Gottlob Haag; Werner-Karl Marquardt, both of Markgroeningen, all of Germany

[73] Assignee: Robert Bosch GmbH, Stuttgart, Germany

[21] Appl. No.: 554,305

[22] Filed: Nov. 8, 1995

[30] Foreign Application Priority Data

Nov. 8, 1994 [DE] Germany ..... 44 39 849.2

[51] Int. Cl.[6] ..... F02N 17/00

[52] U.S. Cl. ..... 123/179.3; 123/179.5; 123/179.18

[58] Field of Search ..... 123/179.3, 179.5, 123/179.12, 179.14, 179.16, 179.17, 179.18, 533

[56] References Cited

U.S. PATENT DOCUMENTS

| | | | |
|---|---|---|---|
| 4,693,224 | 9/1987 | McKay | 123/531 |
| 4,899,714 | 2/1990 | Schechter et al. | 123/533 |
| 5,074,263 | 12/1991 | Emerson | 123/179.5 |
| 5,323,743 | 6/1994 | Kristiansson | 123/179.3 |
| 5,404,717 | 4/1995 | Nogi et al. | 123/179.18 |

FOREIGN PATENT DOCUMENTS

| | | |
|---|---|---|
| 0455576 | 11/1991 | European Pat. Off. . |
| 0887430 | 8/1953 | Germany . |
| 4122868 | 1/1992 | Germany . |
| 2166193 | 4/1986 | United Kingdom . |
| 2274138 | 7/1994 | United Kingdom . |
| 93/04278 | 3/1993 | WIPO . |

*Primary Examiner*—Andrew M. Dolinar
*Attorney, Agent, or Firm*—Edwin E. Greigg; Ronald E. Greigg

[57] ABSTRACT

A method and apparatus for starting an internal combustion engine, which comprises setting one piston of the internal combustion engine into a favorable starting position (X) and to supply a fuel/air mixture to the combustion space by means of a starting air source before the starting of the internal combustion engine.

29 Claims, 4 Drawing Sheets

METHOD AND APPARATUS FOR STARTING AN INTERNAL COMBUSTION ENGINE

PRIOR ART

The invention is based on a method, and apparatus for starting an internal combustion engine.

An expensive and relatively large construction of the starting installation with a powerful electric motor, a so-called starter motor, has previously been used for starting an internal combustion engine.

In order to start the internal combustion engine, it has previously been necessary to bring the internal combustion engine up to a rotational speed of at least some 60 to 100 rpm by means of the starter motor. Because of the force reserves necessary for this purpose, the electric motor used in the known starting installation must be very powerful. Because of the fluctuating torque requirement of the internal combustion engine and the varying starting rotational speed necessary and also because of a variation in the performance of the electric battery, substantial problems often occur in the known starting installation, particularly at low temperatures.

Because the electric motor has to bring the internal combustion engine up to relatively high rotational speeds, there has to be a one-way system and an overrunning clutch between the electric motor and the internal combustion engine. This involves additional constructional outlay.

Because of the high torque required and the relatively high rotational speed necessary, the electric motor for the starting installation is of large and heavy construction.

ADVANTAGES OF THE INVENTION

The method and apparatus according to the invention have, in contrast, the advantage that the internal combustion engine can be started without a starter motor to accelerate the piston to a required minimum speed.

Placing the piston in a starting position which is favorable for attaining a high piston acceleration provides the advantage that the internal combustion engine can be started without using a starter motor which accelerates the piston to the minimum speed otherwise required for starting.

The provision of a starting air source operating independently of the internal combustion engine provides the advantage that the internal combustion engine can be started without a relatively heavy so-called starter motor.

The provision of the starting air source operating independently of the internal combustion engine provides the advantage that a certain quantity of air, which is used in particular for preparing the fuel, can be supplied to the fuel before the ignition of the fuel and before the internal combustion engine is operating.

Advantageous further developments and improvements of the method and apparatus are possible by means of the measures listed in hereinafter.

Bringing the air and the fuel together before the air is blown into the combustion space provides the advantage that a very well prepared, easily ignitable fuel/air mixture is obtained in the combustion space.

Providing the starting air source which operates independently of the internal combustion engine—for blowing, into the combustion space, a defined fuel quantity which corresponds to the air quantity associated with the position of the piston—provides the advantage that an easily ignited mixture can be supplied to the combustion space.

The setting speed with which the piston is adjusted into the desired starting position can be selected to be substantially smaller than the starting speed necessary for starting the internal combustion engine. In particular, this offers the advantage that the adjustment of the piston into the favorable starting position can be effected by means of a relatively small, relatively low-powered and simple setting drive.

If the piston has already been set into the desired starting position a relatively short time after the internal combustion engine has been put out of operation, this offers the advantage that the renewed starting of the internal combustion engine can take place rapidly and without a waiting period.

Driving the setting drive and the starting air source by a common drive additionally and advantageously reduces the constructional outlay required.

If the coupling device is configured in such a way that it drive-connects the setting drive either to the piston or to the starting air source, this offers the advantage that the setting drive and the starting air source do not have to be driven jointly.

BRIEF DESCRIPTION OF THE DRAWINGS

Selected, particularly advantageous embodiment examples of the invention are represented in a simplified manner in the drawing and are explained in more detail in the following description.

DETAILED DESCRIPTION OF THE EMBODIMENT EXAMPLES

The method, according to the invention, for starting an internal combustion engine and the apparatus configured according to the invention for starting an internal combustion engine can be used for starting various internal combustion engines. The internal combustion engine is, for example, a spark-ignition engine with external or internal mixture formation and external ignition, it being possible to provide the engine with a reciprocating piston (reciprocating piston engine) or with a rotatably supported piston (Wankel rotary piston engine). The internal combustion engine can, for example, also be a hybrid engine. In this engine with charge layering, the fuel/air mixture is enriched in the region of the ignition plug to such an extent that reliable flame generation is guaranteed whereas, on average, combustion takes place with a greatly weakened mixture. This engine also has externally supplied ignition for the fuel/air mixture.

The supply and removal of the gaseous media to and from the combustion space of the internal combustion engine can, for example, take place in accordance with the four-stroke cycle or in accordance with the two-stroke cycle. Inlet and exhaust valves can be provided for controlling the supply and removal of the gaseous media.

The internal combustion engine can, for example, have one cylinder with one piston or it can be provided with a plurality of cylinders and a corresponding number of pistons.

In order to prevent the scope of the description becoming unnecessarily large, the following description of the embodiment examples is limited to a reciprocating piston engine with three cylinders to represent the internal combustion engine. The internal combustion engine operates in accordance with the four-stroke cycle and the ignition of the fuel/air mixture in the combustion space takes place with external ignition by means of an ignition device. The invention described as an example below can also be applied without difficulty to other types of internal combustion engines.

Figure 1:
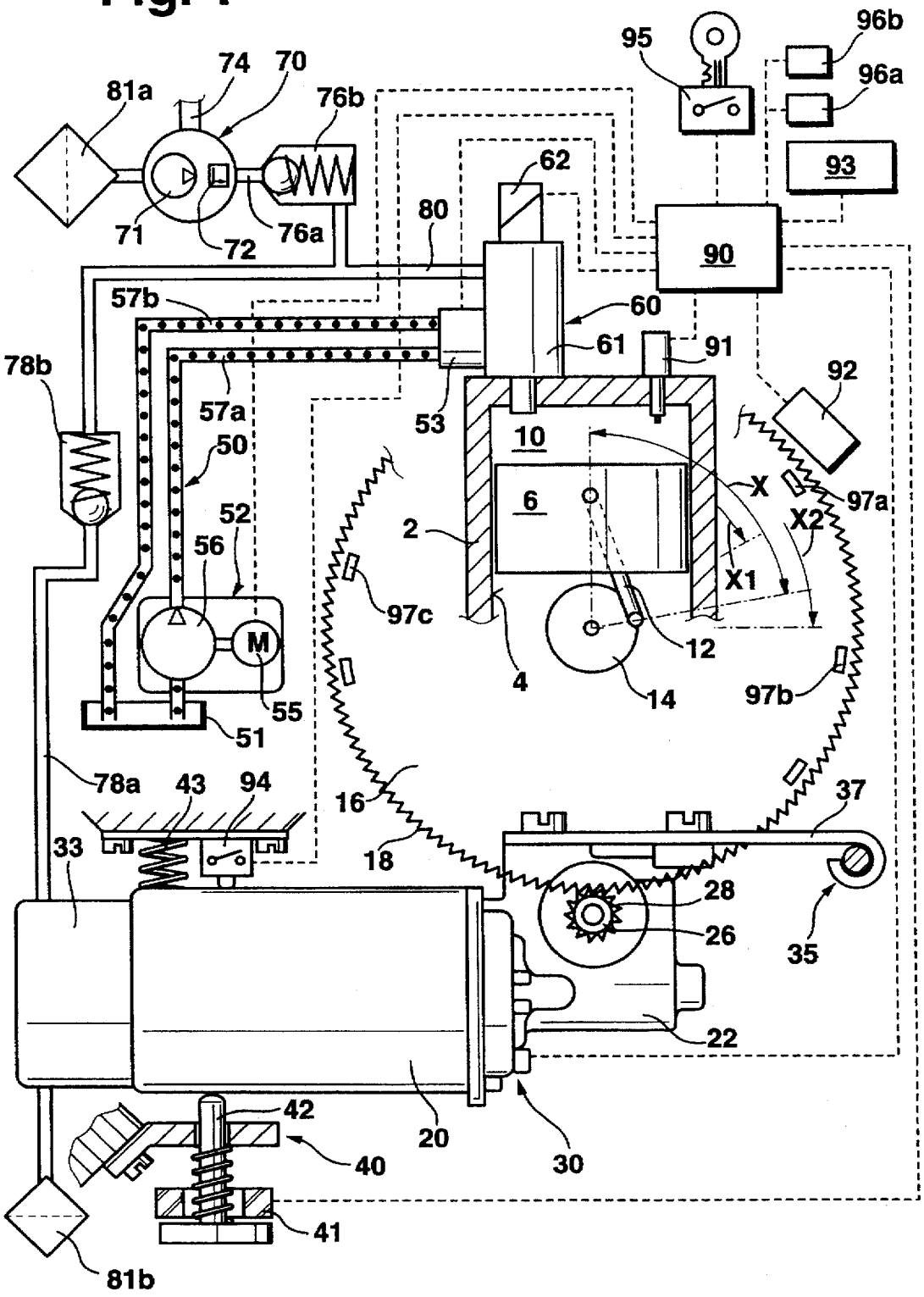
FIGS. 1 and 2 show a selected, particularly advantageously configured schematic of an embodiment example

FIG. 1 shows a first selected embodiment example.

FIG. 1 shows a cylinder 2 of an engine block of an internal combustion engine. For greater clarity, only various parts of the cylinder 2 are represented in section. A cylinder space 4 is formed within the cylinder 2. A piston 6 is supported so that it can be reciprocated within the cylinder space 4. The part of the cylinder space 4 located above the piston 6 (referred to the view represented in the drawing) forms a combustion space 10. The reciprocating piston 6 bounds the combustion space 10.

The piston 6 is connected to a crankshaft 14 by means of a connecting rod 12. The drawing shows the crankshaft 14 in end view. A driving disk 16 is torsionally connected to the crankshaft 14 and the driving disk 16 has teeth 18 on its outer periphery.

The driving disk 16 usually consists of a nontransparent metal. For greater clarity, however, the driving disk 16 is represented in the drawing as if it were to consist of a material as transparent as glass. Only the teeth 18 can therefore be seen. Likewise for greater clarity, only some of the teeth 18 of the driving disk 16 are represented.

A driving motor 20 is shown in FIG. 1. A transmission gear 22 is associated with the driving motor 20. A driving wheel 26 is located at the effective output of the transmission gear 22. Teeth 28 are provided on the outer periphery of the driving wheel 26. The driving motor 20 drives the driving wheel 26 through the transmission gear 22 with a corresponding transmission ratio. The transmission gear 22 ensures a reduction of the rotational speed of the driving motor 20 to a relatively low rotational speed of the driving wheel 26.

The driving motor 20 together with the transmission gear 22 and the driving wheel 26 form a setting drive 30 for adjusting the driving disk 16, and therefore for adjusting the piston 6.

A starting air source 33 is mechanically drive-connected to the driving motor 20 of the setting drive 30.

A swivel fastening 35 is located on the engine block of the internal combustion engine. A lever arm 37 is pivotably supported on the swivel fastening 35. The driving motor 20, the transmission gear 22, the driving wheel 26, the starting air blower 33 and the lever arm 37 form a per se rigid, pivotably supported and interconnected structural unit, the swivel fastening 35 serving as the center of rotation.

In the case of the embodiment example represented in FIG. 1, there is also a coupling device 40. The coupling device 40 consists essentially, as an example, of an electromagnet 41, a pin 42 and a spring 43.

When current is supplied to the electromagnet 41, the pin 42 acts on the setting drive 30 and rotates the setting drive 30 in the clockwise direction (referred to the view shown in FIG. 1) about the swivel fastening 35 so that the teeth 28 of the driving wheel 26 come into engagement with the teeth 18 of the driving disk 16. If no current is supplied to the electromagnet 41, the coupling device 40 rotates, by means of the spring 43, the setting drive 30 in the anti-clockwise direction (referred to FIG. 1) about the swivel fastening 35 so that the driving wheel 26 and the driving disk 16 come out of engagement so that the setting drive 30 is disconnected from the driving disk 16 and the piston 6.

A fuel metering system 50 is also present. The fuel metering system 50 includes a fuel tank 51, a fuel pump and motor 52 and a fuel metering valve 53—as well as various fuel conduits. The fuel pump 52 consists essentially of an electric motor 55, a pump 56 and a pressure regulating valve; the latter is not represented. The fuel pump 52 delivers the fuel from the fuel tank 51 through a fuel conduit 57*a* to the fuel metering valve 53. The fuel not required during the particular operating condition of the internal combustion engine is returned to the fuel tank 51 through a fuel return conduit 57*b*. In order to distinguish them clearly from other conduits, those carrying fuel are symbolically represented by two parallel lines with spots between the parallel lines. The fuel pump 52 delivers fuel at substantially constant pressure through the fuel conduit 57*a* to the fuel metering valve 53.

There is an air injection valve 60 in the region of the cylinder 2. The air injection valve 60 includes a mixture control valve 61 and a control magnet 62.

The apparatus has an air source 70. The air source 70 consists essentially of an air compressor 71 and an air pressure regulator 72. The air compressor 71 of the air source 70 has a direct mechanical drive from the internal combustion engine via mechanical transmission means 74. The delivery of air by the air source 70 is therefore associated with the motion of the crankshaft 14 and therefore with the motion of the piston 6. The air source 70 can only supply air when the internal combustion engine is already in operation.

The air source 70 is connected to the air injection valve 60 by means of an air conduit 76*a*. There is a non-return valve 76*b* in the line of the air conduit 76*a*. The starting air source 33 is likewise connected to the air injection valve 60 by means of an air conduit 78*a*. Again, there is a non-return valve 78*b* in the air conduit 78*a*. The non-return valves 76*b* and 78*b* ensure that the air from the starting air source 33 can reach the air injection valve 60 and that the air from the air source 70 can reach the air injection valve 60 but they shut off the air in the reverse direction so that the air supplied by the starting air source 33 cannot escape via the air source 70 and the air supplied by the air source 70 cannot escape via the starting air source 33. Parts of the air conduits 76*a* and 78*a* are brought together in a common air conduit 80 in the direction towards the air injection valve 60. There is an air filter 81*a* on the suction side of the air source 70 and there is an air filter 81*b* on the suction side of the starting air source 33. Given appropriate routing of the air conduits, the two air filters 81*a* and 81*b* may be replaced by a common air filter.

The embodiment example represented in the drawing shows a control device 90, an ignition device 91, a position pick-up 92, a power supply unit 93, a relay 94, a switch 95 and, if required, a sensor 96*a* or a plurality of sensors 96*a*, 96*b*. The driving motor 20, the electromagnet 41, the electric motor 55, the fuel metering valve 53, the control magnet 62, the ignition device 91, the position pick-up 92, the power supply unit 93, the relay 94, the switch 95 and the sensors 96*a*, 96*b* are connected to the control device 90 by means of electrical lines. For greater clarity, the electrical lines are shown in the drawing as interrupted lines independently of how many cores the respective line has.

Figure 2:
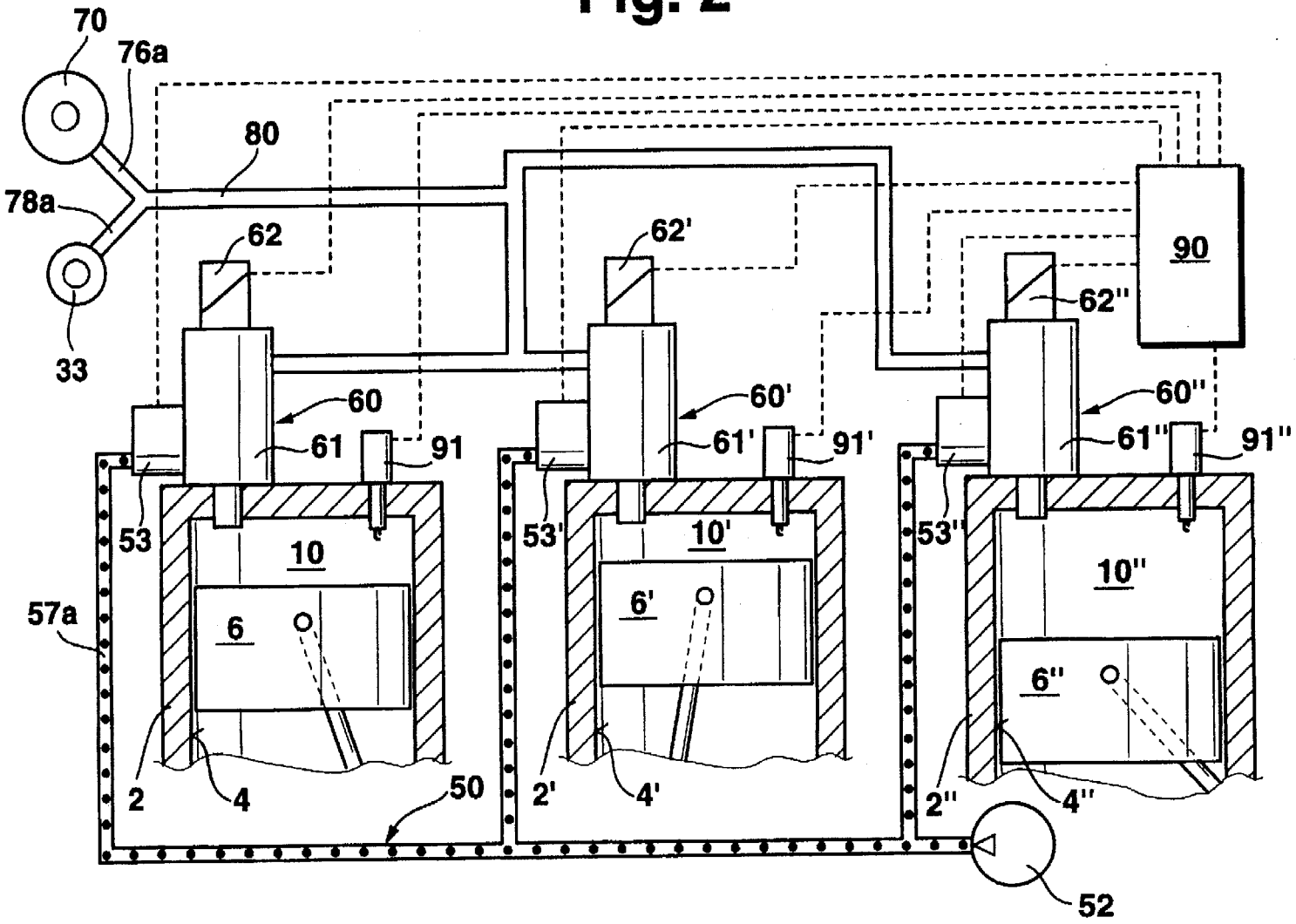

FIG. 2 shows further details of the same embodiment example.

In all the figures, the same parts or parts acting in the same way are provided with the same reference symbols.

FIG. 2 shows the three cylinders 2, 2', 2" with the three pistons 6, 6', 6" and the combustion spaces 10, 10', 10" of the three-cylinder internal combustion engine selected as an example. The fuel/air mixture is blown into the combustion spaces 10, 10', 10" with the aid of the air injection valves 60, 60', 60" associated with the respective combustion spaces 10, 10', 10". The air injection valves 60, 60', 60" receive exactly metered fuel by means of respective fuel metering valves 53, 53', 53" of the fuel metering system 50. Each air injection valve 60, 60', 60" is connected to the air source 70 and to the starting air source 33 by means of the air conduit 80. The fuel/air mixture can be supplied in the correct quantity and at exactly the right instant for the individual cylinders 2, 2', 2" to each combustion space 10, 10', 10" by means of the air injection valves 60, 60', 60".

The piston 6 reciprocates in the cylinder space 4. The highest position of the piston 6 is designated the top dead center and the lowest position of the piston 6 is designated the bottom dead center. This also applies correspondingly to the pistons 6', 6" in the cylinder spaces 4' and 4". The motions of the pistons 6, 6', 6" are offset relative to one another.

For the purpose of better understanding of the appliance for starting the internal combustion engine and of the method for starting the internal combustion engine, three different operating conditions (N), (R) and (S) are distinguished below: (N) signifies the normal operating condition of the internal combustion engine; (R) signifies the rest condition of the internal combustion engine; (S) signifies the starting procedure operating condition of the internal combustion engine.

First of all, some explanations with respect to the normal operating condition (N):

In the normal operating condition (N), the piston 6 moves downwards, starting from top dead center after the exhaust stroke. Fresh fuel/air mixture then flows into the combustion space 10. This phase is designated the induction stroke. The fuel/air mixture is subsequently compressed, approximately between bottom dead center and top dead center, for which reason this phase is designated the compression stroke. In the normal operating condition (N) of the internal combustion engine, the fuel/air mixture is ignited by means of the ignition device 91 shortly before reaching top dead center, for which reason the expansion stroke, also designated the combustion stroke, follows on from the compression stroke. The so-called exhaust stroke then occurs as the fourth phase of the four-stroke process.

In the normal operating condition (N) of the internal combustion engine, the switch 95 is switched on and the crankshaft 14 rotates at the desired or possible rotational speed. The air source 70 is mechanically driven by the crankshaft 14 and supplies air at a certain pressure to the air injection valves 60, 60', 60". The fuel pump 52 supplies fuel to the fuel metering valves 53, 53', 53". Depending on the operating condition, and as a function of the signals supplied by the control device 90, the fuel metering valves 53, 53', 53' supply a quantity of fuel, which is accurately metered for each cylinder 2, 2', 2", to the air injection valves 60, 60', 60". The excess quantity of fuel is returned to the fuel tank 51 via the fuel return conduit **57*b* (not represented in FIG. 2** for ease of comprehension).

The air and the fuel are brought together in the mixture control valves 61, 61', 61" of the air injection valves 60, 60', 60" and are supplied to the combustion spaces 10, 10', 10". The control magnets 62, 62', 62" of the air injection valves 60, 60', 60" are controlled by the control device 90 and ensure that the mixture of air and fuel reaches the respective combustion spaces 10, 10', 10" at the correct instant and in the correct quantity. During the normal operating condition (N), the fuel/air mixture can be blown into the combustion spaces 10, 10', 10" in known manner during the respective induction stroke or at the beginning of the compression stroke in order to achieve the highest possible internal combustion engine efficiency.

The ignition devices 91, 91', 91" can generate ignition sparks in the combustion spaces 10, 10', 10". The ignition devices 91, 91', 91" ignite the fuel/air mixture in the combustion space 10, 10', 10" at the respectively correct instant and the pistons 6, 6', 6" are accelerated downwards (referred to FIGS. 1 and 2) by this means.

During the normal operating condition (N), no electrical energy is supplied to the driving motor 20 so that the starting air source 33 is at rest in the normal operating condition (N) and does not supply any air. The electromagnet 41 is not supplied with current either so that the setting drive 30 is pivoted anti-clockwise (referred to FIG. 1) and is therefore not in engagement with the driving disk 16. The setting drive 30, including the starting air source 33, does not function during the normal operating condition (N).

Some explanations with respect to the rest condition (R)—defined above in this description—of the internal combustion engine are now given:

When the switch 95 is switched off, the fuel pump 52 is switched off and the fuel metering valves 53, 53', 53" interrupt the metering of fuel to the combustion spaces 10, 10', 10". When the fuel supply to the combustion spaces 10, 10', 10" and the ignition devices 91, 91', 91" are switched off, the crankshaft 14, and therefore the driving disk 16, come to rest after a short period. The position pick-up 92 checks whether the driving disk 16 has come to rest. The position pick-up 92 can sense the motion of the driving disk 16 and its exact particular position by means of the teeth 18 on the driving disk 16. It is, however, also possible for various markings **97*a*, 97*b*, 97*c* to be applied to the driving disk 16; these can be used by the position pick-up 92 to sense the motion of the driving disk 16 and also the exact setting position of the driving disk 16**.

An angle X is plotted in FIG. 1. The angle X designates the angle of the crankshaft 14 which the crankshaft 14 has traversed since passing through the top dead center position of the piston 6. The angle X is approximately 80°. At this angle of 80°, the crankshaft 14 is at a position which is particularly favorable for the starting procedure carried out in accordance with the invention. For this reason, this position of the crankshaft 14 is designated in what follows as the favorable starting position X. It is not necessary to maintain the 80° exactly. If the angle is approximately 60°, this can still be designated as a favorable starting position. This angle is designated by X1 in FIG. 1. If the angle between the top dead center and the setting position of the crankshaft 14 is approximately 90°, this can likewise still be designated as a favorable starting position. This angle is plotted in FIG. 1 and is designated by X2. It is also possible to start the internal combustion engine at an angle which is somewhat smaller than X1 (for example 50°) and at an angle which is somewhat larger than X2 (for example 100°), in each case depending on the readiness of the internal combustion engine to start, but the conditions are then somewhat less favorable.

The favorable starting position X, preferably approximately 80°, is selected in such a way that the largest possible lever arm is formed on the crankshaft 14 so that the piston 6 can put the crankshaft 14 into motion with the smallest possible force but, on the other hand, so that there is still sufficient stroke before bottom dead center is reached.

The position of the crankshaft 14 is rigidly associated with the positions of the pistons 6, 6', 6" so that the favorable starting position X corresponds to accurately defined positions of the pistons 6, 6', 6".

If the position pick-up 92 finds that the driving disk 16, and therefore the piston 6 coupled to the driving disk 16, has come to rest in the desired favorable starting position X, or between the two limiting values X1 and X2, the driving disk 16 is then left in this starting position. If, however, the position pick-up 92 finds that the driving disk 16, and therefore the piston 6, has not come to rest in the favorable starting position X, or in the permissible range around the favorable starting position X, the control device 90 then gives the instruction to adjust the piston 6 into the favorable starting position X.

For this purpose, the electromagnet 41 is first supplied with current and this brings the driving wheel 26 into effective engagement with the driving disk 16. The driving motor 20 of the setting drive 30 is subsequently supplied with current, specifically until such times as the position pick-up 92 finds that the driving disk 16 has reached the favorable starting position X.

Depending on what is most favorable for the internal combustion engine, the setting drive 30 can be configured in such a way that it always adjusts the driving disk 16 in the clockwise direction or always adjusts it in the anti-clockwise direction. The setting drive 30, however, can also be configured in such a way that it can be activated so as always to rotate the driving disk 16 in the direction of rotation in which the favorable starting position X is reached with the smallest angle of rotation.

As soon as the piston 6 has reached the favorable starting position X, the supply of current to the setting drive 30 is shut off and, immediately afterwards, the supply of current to the electromagnet 41 is also interrupted. Because of this, the spring 43 of the coupling device 40 rotates the setting drive 30 anti-clockwise around the swivel fastening 35 so that the setting drive 30 is disconnected from the driving disk 16. The setting drive 30 remains in this disconnected position unless, after the internal combustion engine has been shut down afresh, the control device 90 again gives the instruction to position the piston 6.

The apparatus for starting the internal combustion engine and the method for starting the internal combustion engine can be configured in such a way that the piston 6 is always set in the favorable starting position X. Alternatively, the apparatus and the method can be configured in such a way that, from among the pistons 6, 6', 6", the piston which is set in the favorable starting position X is always the one which—after the switch 95 has been switched off—had come to rest in such a way that it is nearest to the favorable starting position X or the permissible range between X1 and X2. In the case of the second of these two possibilities described, the corresponding piston position is stored in the control device 90 until the next start.

Now, some explanations with respect to the starting procedure operating condition (S) of the internal combustion engine:

For the following description, it is assumed that the first piston 6 is used for the starting procedure (S), although the piston 6' or the piston 6" could also be used.

After actuation of the switch 95, the fuel pump 52 of the fuel metering system 50 is switched on and, simultaneously, the driving motor 20 of the setting drive 30 is also switched on. The driving motor 20 drives the starting air blower 33 which delivers the air through the air conduit 78*a*, 80 into the air injection valve 60. The fuel metering valve 53 delivers fuel into the air injection valve 60. Shortly after this, the control magnet 62 opens the air injection valve 60 in the direction towards the combustion space 10 so that the fuel/air mixture is delivered from the air injection valve 60 into the combustion space 10. As soon as the combustion space 10 has been filled, as planned, with the fuel/air mixture, the ignition device 91 ignites the fuel/air mixture in the combustion space 10. By this means, the piston 6 is driven downwards (referred to FIGS. 1 and 2).

Because of the supply of the air delivered by the starting air source 33 and because the air is brought together with the fuel in the mixture control valve 61 of the air injection valve 60 before the fuel/air mixture reaches the combustion space 10, very good preparation of the fuel and optimum mixing of the mixture are achieved. An excellent, easily ignited mixture is obtained in the combustion space 10.

Because the internal combustion engine normally has a plurality of cylinders, it is obviously impossible for all the pistons 6, 6', 6" of the various cylinders 2, 2', 2" to be in the favorable starting position X at the beginning of the starting procedure (S).

If, for example, the piston 6' is located before top dead center during the so-called compression stroke at the beginning of the starting procedure (S), the air injection valve 60' is then opened by means of the control magnet 62' until the piston 6' reaches its top dead center. While the air injection valve 60' is being opened, the fuel metering valve 63' remains closed. Because of this measure, the compression pressure prevailing in the mixing control valve 61' of the air injection valve 60' is the same as that in the combustion space 10'. The air injection valve 60' is now closed in the region of the top dead center of the second piston 6' of the second cylinder 2'. The desired quantity of fuel is now added to the mixing control valve 61' by means of the fuel metering valve 53'. After the second piston 6' has passed through top dead center, the second air injection valve 60' is opened and the fuel/air mixture is fed into the expanding combustion space 10'. When the second piston 6' subsequently passes through its favorable starting position X, it is preferable for the ignition device 91' of the second cylinder 2' to ignite the fuel/air mixture in the second combustion space 10'.

Substantially the same procedure occurs in the case of the third cylinder 2" as has occurred in the case of the second cylinder 2'. Here again, the air injection valve 60" is opened during the compression stroke and the fuel/air mixture is supplied into the third combustion space 10" during the expansion stroke and, when the third piston 6" is located in the region of the favorable starting position X, the fuel/air mixture is ignited by the ignition device 91" of the third cylinder 2".

It is fundamentally also possible to keep the air injection valves 60', 60" of the cylinders 2' and 2" closed during the compression stroke of these cylinders and to blow the fuel previously stored in the air injection valves 60' and 60" into the combustion space 10' and 10", respectively, during the expansion stroke with the aid of the compressed air supplied from the starting air source 33.

It is also possible to provide for the same procedure as occurred in the case of the second and third cylinders 2', 2" to be again carried out in the case of further cylinders which may be present. If necessary, this procedure can likewise also be repeated on the next cycle in the case of the first cylinder 2 until the internal combustion engine has arrived at its planned minimum operational rotational speed.

The crankshaft 14 is increasingly accelerated by this starting procedure (S) and the air source 70 is, correspondingly, mechanically driven by means of the mechanical transmission means 74. This air source 70 now delivers air to the air injection valves 60, 60', 60" via the air conduit 76*a*, 80. Now that the crankshaft 14 is rotating, the air source 70, which is mechanically connected to the crankshaft 14, delivers air to the air injection valves 60, 60', 60" and it is possible to dispense with the starting air source 33. For this reason, the supply of current to the driving motor 20 of the setting drive 30, which motor 20 drives the starting air source 33, is now switched off.

During the starting procedure (S) and while the driving motor 20 is driving the starting air source 33, the driving wheel 26 of the setting drive 30 is also rotating. Because, however, the coupling device 40 has separated the driving wheel 26 from the driving disk 16, the driving wheel 26 rotates without any connection to the driving disk 16 and, therefore, without any appreciable resistance.

After the crankshaft 14 of the internal combustion engine has come to a certain adequate rotational speed, the control device 90 sets the injection of the fuel and air and the ignition to the normal operating condition (N). In the normal operating condition (N), the addition of fuel and the injection of the fuel/air mixture is displaced, as usual, into the region of the suction stroke or the beginning of the compression stroke in the case of the internal combustion engine operating, for example, on the four-stroke cycle.

With the aid of the relay 94, the control device 90 can determine whether the coupling device 40 has correctly connected the setting drive 30 to the driving disk 16, and therefore to the piston 6.

As has already been explained in the case of the rest condition (R), the piston 6 is set into the starting position X, which is favorable for the starting procedure, immediately after or a short time after the internal combustion engine has been shut down. The piston 6 is held in this position until the next starting procedure. This can, for example, take place by means of a switchable locking device (not represented) which locks the driving disk 16 when the internal combustion engine is switched off and therefore retains the piston 6 in the favorable starting position. If no locking device is provided, it can possibly happen, in exceptional cases, that the piston 6 leaves the favorable starting position X while the internal combustion engine is switched off. In order to provide a remedy for this case also, the control device 90 can be configured in such a way that when it obtains information from the switch 95 that the internal combustion engine is to be put into operation, it first checks whether the piston 6, or one of the pistons 6, 6', 6" provided for the starting procedure (S), is in the favorable starting position X. If this is not the case, one of the pistons 6, 6', 6" is set into the favorable starting position X before the actual starting procedure (S), as described above. The fact that the planned piston 6, 6', 6" is not in the favorable starting position X does not normally occur. It only happens when the internal combustion engine has been manipulated by external force after the internal combustion engine has been shut down. Normally, therefore, the internal combustion engine can be started immediately.

Figure 3:
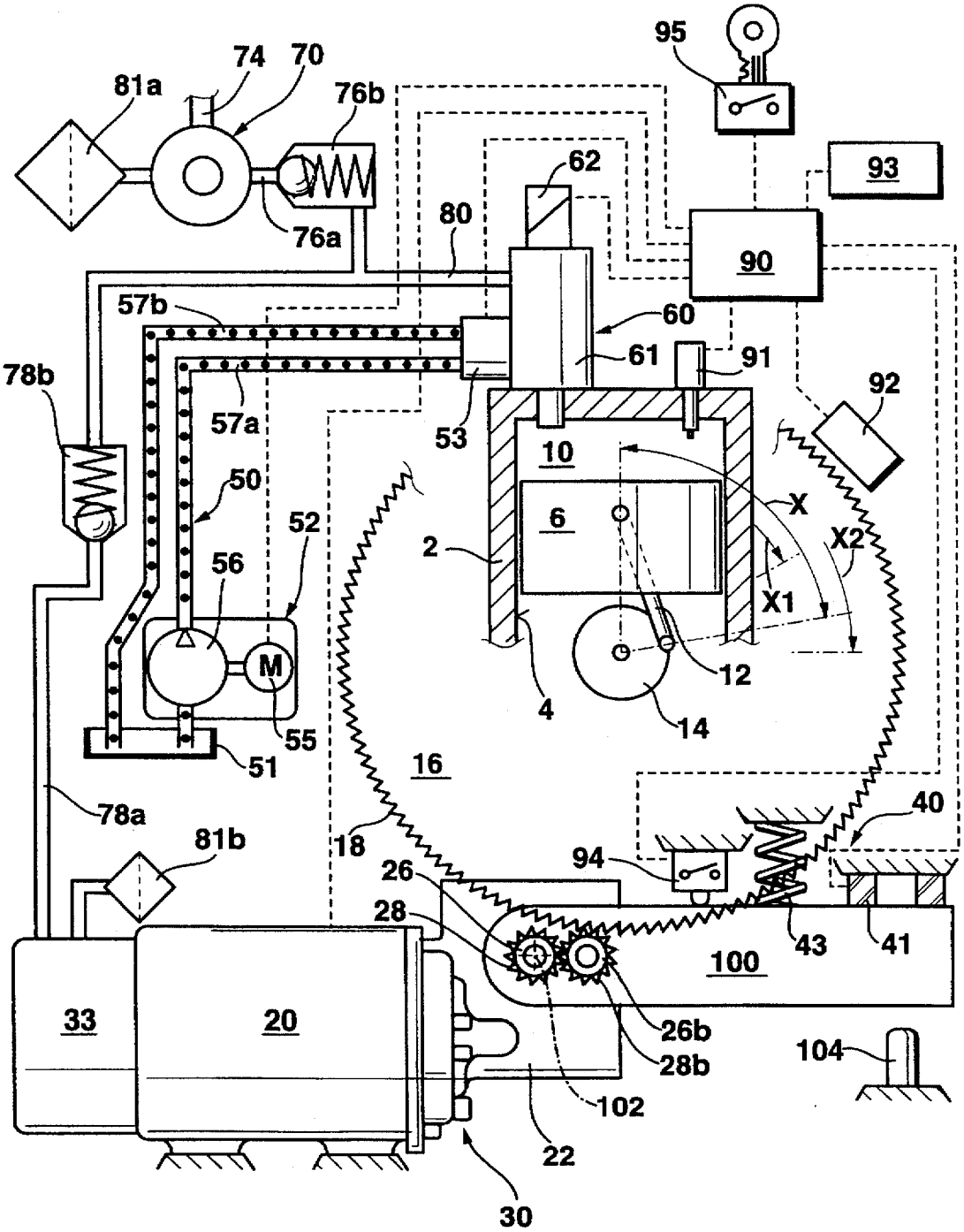
FIGS. 3 and 4 show further selected, advantageously configured embodiment schematic examples of the invention.

FIG. 3 shows a further and preferred, selected embodiment example.

If nothing to the contrary is mentioned or represented in the drawing, what has already been mentioned and represented, using one of the embodiment examples, also applies in the case of the other embodiment examples. If nothing different emerges from the explanations, the details of the various embodiment examples can be combined with one another.

In the embodiment example represented in FIG. 3, there is a pivoting lever 100. The pivoting lever 100 is supported, so that it can be freely pivoted, in the region of one of its two ends on the shaft of the driving wheel 26 which can be driven by the setting drive 30. The center of the driving wheel 26 forms a pivoting axis 102 for the pivoting lever 100. A further driving wheel 26*b* is rotatably fixed on the pivoting lever 100. On its outer periphery, the driving wheel 26*b* has teeth 28*b*. The driving wheel 26*b* is in continuous effective engagement with the driving wheel 26. The diameters of the two driving wheels 26, 26*b* can be different and matched to one another in such a way that there is a transmission ratio, which forms part of the transmission gear 22, between these two driving wheels 26, 26*b*.

When electrical current is supplied to the electromagnet 41 of the coupling device 40, the coupling device 40 rotates the pivoting lever 100 anti-clockwise (referred to FIG. 3) about the pivoting axis 102, which is concentric with the driving wheel 26. This brings the driving wheel 26*b* into effective engagement with the driving disk 16.

If the supply of electrical current to the electromagnet 41 is interrupted, the coupling device 40 pivots the pivoting lever 100 clockwise (referred to FIG. 3) with the aid of the spring 43 until the pivoting lever 100 comes into contact with a stop 104 fixed to the casing.

In the embodiment example represented in FIG. 3, the driving motor 20 of the setting drive 30 and the starting air source 33 are fastened so that they are stationary. This has the advantage that the electrical lines leading to the driving motor 20 and the air conduits connected to the starting air source 33 do not have to be moved and, therefore, can be less flexible and are less susceptible to faults.

Figure 4:
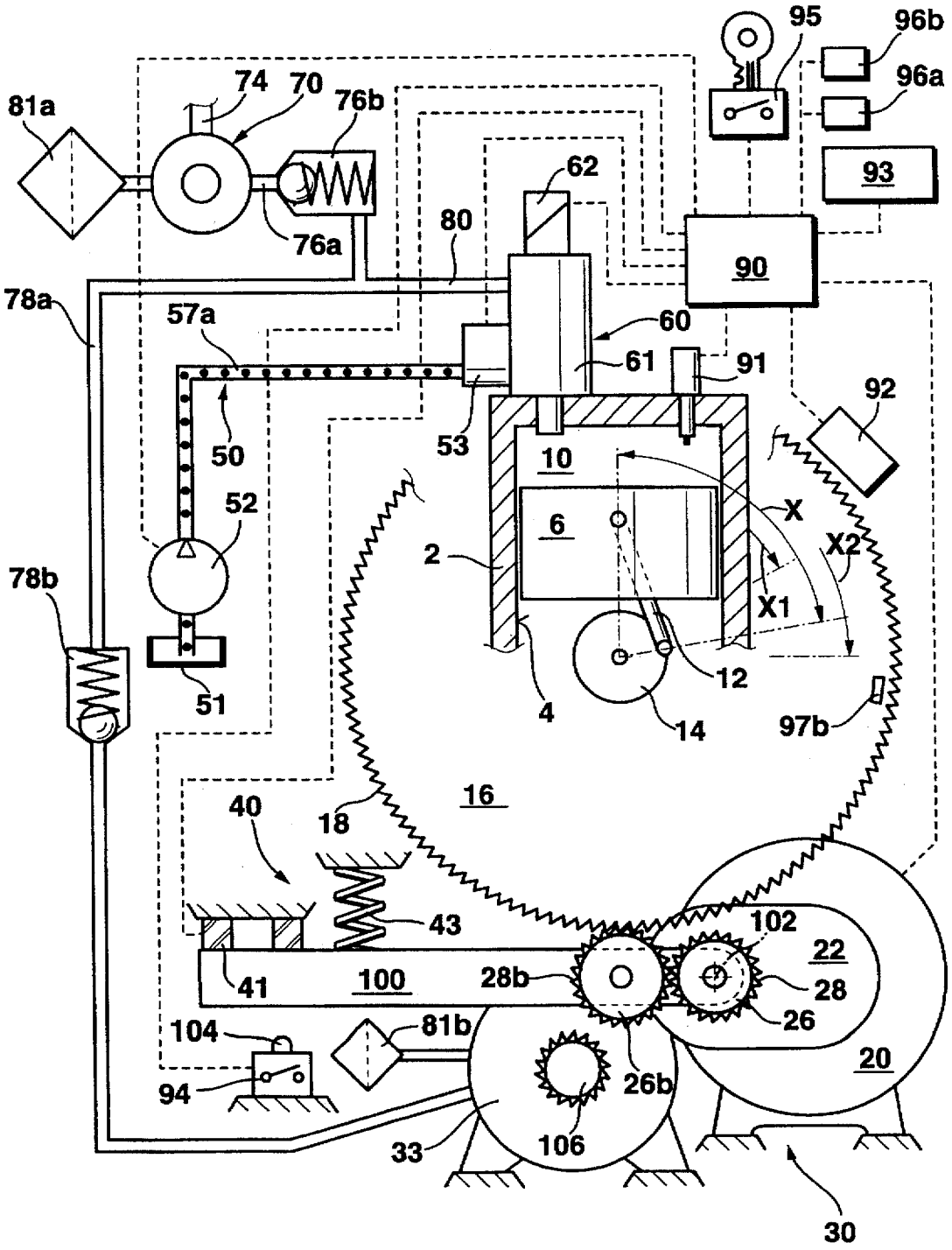

FIG. 4 shows a further and preferred, selected embodiment example.

In the embodiment examples represented in FIGS. 1 and 3, the starting air source 33 is effectively connected to the driving motor 20 of the setting drive 30 continuously. The starting air source 33 always rotates together with the driving motor 20. In the embodiment example represented in FIG. 4, however, the starting air source 33 does not always have to be connected to the driving motor 20. In FIG. 4, the starting air source 33 has a driving wheel 106. If this driving wheel 106 is driven, the starting air source 33 delivers air to the air injection valves 60, 60', 60" through the air conduit 78*a*, 80.

When electrical current is supplied to the electromagnet 41, the coupling device 40 pivots the pivoting lever 100 clockwise (referred to the representation in FIG. 4) and this effectively connects the driving motor 20 to the piston 6 via the transmission gear 22, via the driving wheel 26, via the driving wheel 26*b* and via the driving disk 16. In this condition, the driving motor 20 can adjust the piston 6 into the favorable starting position X. In this position of the pivoting lever 100, there is no effective connection between the driving motor 20 and the starting air source 33.

If no electrical current is supplied to the electromagnet 41, the spring 43 of the coupling device 40 adjusts the pivoting lever 100 anti-clockwise (referred to FIG. 4) and this brings the driving wheel 26*b* into effective engagement with the driving wheel 106. In this position of the pivoting lever 100, the driving motor 20 of the setting drive 30 can drive the starting air source 33.

In order to position the piston 6, the coupling device 40 pivots the pivoting lever 100 clockwise (referred to FIG. 4) and connects the driving motor 20 to the driving disk 16. In order to operate the starting air source 33 during the starting procedure (S) of the internal combustion engine, the coupling device 40 pivots the pivoting lever 100 anti-clockwise (referred to FIG. 4) as far as the stop 104- In this position of the pivoting lever 100, the driving motor 20 is effectively connected to the starting air source 33. During the normal operating condition (N), no electrical current is supplied to the electromagnet 41 so that the setting drive 30 is disconnected from the driving disk 16. As soon as the internal combustion engine has started, i.e. is in the normal operating condition (N), no electrical current is supplied to the driving motor 20 and, in consequence, the starting air source 33 does not deliver any air either. In the normal operating condition (N), the air supplied to the combustion space 10 comes from the air source 70, which is drive-connected to the crankshaft 14.

The driving motor 20 obtains its power from the power supply unit 93. The driving motor 20 is usually a small electric motor and the power supply unit 93 is an electric battery. The driving motor 20 can operate completely independently of whether the crankshaft 14 of the internal combustion engine rotates or not. The driving motor 20 is indirectly dependent on the internal combustion engine only to the extent that the power of the power supply unit 93 normally comes at least indirectly from the internal combustion engine. This also applies correspondingly to the fuel pump 52 with the electric motor 55.

Because the driving motor 20 can also operate while the internal combustion engine is at rest, the setting drive 30 and the starting air source 33 are also ready for use when the crankshaft 14 is at rest. The setting drive 30 and the starting air source 33 are practically independent of the internal combustion engine. The setting drive 30 and the starting air source 33 are dependent on the internal combustion engine only to the extent that the electrical power of the power supply unit 93 comes indirectly from the internal combustion engine.

In order to reach the favorable starting position X, the crankshaft 14 only has to be rotated by a relatively small angle so that the rotation of the crankshaft 14 can take place relatively slowly. The rotational speed required for this is very much smaller than the minimum rotational speeds previously necessary for starting in the case of conventional starting with a conventional starter motor. In the apparatus configured according to the invention, it is therefore sufficient for the driving motor 20 to be made small and of relatively low power. Because the transmission gear 22 between the driving motor 20 and the crankshaft 14 reduces the output rotational speed of the driving motor 20, there is an increase in the torque, which additionally favors the use of a low-torque driving motor 20. It is, for example, possible to use for the driving motor 20 an electric motor of the type usual for actuating windshield wipers.

The air source 70 operating during the normal operating condition (N) must be relatively large and, in consequence, an electrical drive is scarcely feasible for this air source 70 because of the size required for the electric motor necessary. Only a mechanical drive is therefore practical for the air source 70. In contrast to this, a small and relatively low-powered driving motor is sufficient for driving the starting air source 33. This driving motor must have a power similar to that of the driving motor for positioning the crankshaft 14 and, in the present application, it is therefore proposed to use the same common driving motor for positioning the crankshaft 14 and for driving the starting air source 33. This offers substantial additional advantages in terms of the components necessary and the total weight.

Because atmospheric pressure is present in the combustion space 10 in the rest condition, the starting air source 33 only has to be able to generate a relatively small excess air pressure. And because the air flow to be delivered by the starting air source 33 is also small, it is sufficient to provide the starting air source 33 with a relatively small and low-powered configuration. The starting air source 33 can, for example, be realized in the form of a vane blower which can be manufactured at favorable cost.

Even if the starting air source 33 in the embodiment examples represented in FIGS. 1 and 3 is continually in effective connection with the driving motor 20 of the setting drive 30, this is not necessarily to be regarded as a disadvantage because even if, in addition, the starting air source 33 is driven unnecessarily when positioning the crankshaft 14, the additional power requirement then necessary is so small that it does not normally play any practical role. Even this particular, and usually negligible, disadvantage of the embodiment examples represented in FIGS. 1 and 3 is additionally overcome in the embodiment example represented in FIG. 4.

It is often unimportant whether the control device 90 is programmed in such a way that the setting drive 30 sets the piston 6 in the favorable starting position X immediately after the internal combustion engine is put out of operation or whether the setting drive 30 puts the piston 6 in the favorable starting position X only directly before a renewed starting of the internal combustion engine. In both cases, the setting drive 30 sets the piston 6 in the favorable starting position X before the ignition device 91 initiates the ignition of the fuel in the combustion space 10 in order to start the internal combustion engine. The possibility that the setting drive 30 sets the piston 6 in the favorable starting position X immediately after the internal combustion engine is put out of operation does, however, offer the substantial additional advantage that the crankshaft 14 can be rotated more easily immediately after the internal combustion engine has been put out of operation and that the later starting of the internal combustion engine can take place more rapidly.

The foregoing relates to preferred exemplary embodiments of the invention, it being understood that other variants and embodiments thereof are possible within the spirit and scope of the invention, the latter being defined by the appended claims.

We claim:

1. An apparatus for starting an internal combustion engine, having at least one piston (6) which is movable in a cylinder space and which bounds a combustion space (10) in the cylinder space, comprising a fuel metering system (50) for metering fuel which is directed into the combustion space (10), an ignition device (91) which extends into said combustion space (10) for initiating ignition of the fuel, and a setting drive (30) is provided which, before ignition, sets the piston (6) in a starting position (X) favorable for achieving a high acceleration of the piston (6) in which starting is initiated by a combustion of the fuel in the combustion chamber.

2. The apparatus as claimed in claim 1, wherein a coupling device (40) which connects the setting drive (30) to the piston (6) and separates the setting drive (30) from the piston (6) is provided to set the piston (6) in the starting position (X).

3. The apparatus as claimed in claim 2, wherein the setting drive (30) is mechanically driven practically independently of the internal combustion engine.

4. The apparatus as claimed in claim 3, wherein a starting air source is provided which is driven by the setting drive (30) and which supplies air to the fuel before the ignition of the fuel.

5. The apparatus as claimed in claim 3, wherein a starting air source (33), which is not directly driven by the internal combustion engine and which supplies air to the fuel before the ignition of the fuel, and a coupling device (40) are provided, the coupling device (40) drive-connects the setting drive (30) either to the piston (6) or to the starting air source (33).

6. The apparatus as claimed in claim 2, wherein a starting air source is provided which is driven by the setting drive (30) and which supplies air to the fuel before the ignition of the fuel.

7. The apparatus as claimed in claim 2, wherein a starting air source (33), which is not directly driven by the internal combustion engine and which supplies air to the fuel before the ignition of the fuel, and a coupling device (40) are provided, the coupling device (40) drive-connects the setting drive (30) either to the piston (6) or to the starting air source (33).

8. The apparatus as claimed in claim 2, wherein a common driving motor (20) is provided which drives the setting drive (30) and a starting air source (33).

9. The apparatus as claimed in claim 1, wherein the setting drive (30) is mechanically driven practically independently of the internal combustion engine.

10. The apparatus as claimed in claim 9, wherein a starting air source is provided which is driven by the setting drive (30) and which supplies air to the fuel before the ignition of the fuel.

11. The apparatus as claimed in claim 9, wherein a starting air source (33), which is not directly driven by the internal combustion engine and which supplies air to the fuel before the ignition of the fuel, and a coupling device (40) are provided, the coupling device (40) drive-connects the setting drive (30) either to the piston (6) or to the starting air source (33).

12. The apparatus as claimed in claim 9, wherein a common driving motor (20) is provided which drives the setting drive (30) and a starting air source (33).

13. The apparatus as claimed in claim 1, wherein a starting air source is provided which is driven by the setting drive (30) and which supplies air to the fuel before the ignition of the fuel.

14. The apparatus as claimed in claim 13, wherein a common driving motor (20) is provided which drives the setting drive (30) and a starting air source (33).

15. The apparatus as claimed in claim 1, wherein a starting air source (33), which is not directly driven by the internal combustion engine and which supplies air to the fuel before the ignition of the fuel, and a coupling device (40) are provided, the coupling device (40) drive-connects the setting drive (30) either to the piston (6) or to the starting air source (33).

16. The apparatus as claimed in claim 15, wherein a common driving motor (20) is provided which drives the setting drive (30) and a starting air source (33).

17. The apparatus as claimed in claim 1, wherein a common driving motor (20) is provided which drives the setting drive (30) and a starting air source (33).

18. An apparatus for starting an internal combustion engine, having at least one piston (6) which is movable in a cylinder space and which bounds a combustion space (10) in the cylinder space, comprising a fuel metering system (50) for metering fuel which is directed into the combustion space (10), an ignition device (91) extends into said combustion space (10) for initiating ignition of the fuel for initiating starting by a combustion in the combustion chamber, a starting air source (33) is provided which is driven practically independently of the internal combustion engine and supplies air to the fuel before the ignition for starting the engine, and a setting drive (30) is provided which sets the piston (6), before ignition, in a starting position (X) favorable for achieving a high acceleration of the piston (6) during starting, and wherein the starting air source (33) is mechanically drive-connected to the setting drive (30) which is inactivated after combustion initiated in the combustion space has started the engine.

19. The apparatus as claimed in claim 18, wherein a common driving motor (20) is provided which drives the setting drive (30) and the starting air source (33).

20. The apparatus as claimed in claim 18, wherein a coupling device (40) is provided, the coupling device (40) drive-connects the setting drive (30) either to the piston (6) or to the starting air source (33).

21. The apparatus as claimed in claim 20, wherein a common driving motor (20) is provided which drives the setting drive (30) and the starting air source (33).

22. The apparatus as claimed in claim 18, wherein a coupling device (40) is provided, the coupling device (40) drive-connects the setting drive (30) indirectly to the piston (6).

23. The apparatus as claimed in claim 22, wherein a common driving motor (20) is provided which drives the setting drive (30) and the starting air source (33).

24. An apparatus as set forth in claim 18, in which the starting position (X) is an angle of from about 60° to about 100° beyond top dead center of piston (6).

25. A method for starting an internal combustion engine, having at least one piston (6) which is movable in a cylinder space and which bounds a combustion space (10) in the cylinder space, comprising operating a setting drive (30) to set the piston (6) in a starting position (X) favorable for achieving a high acceleration of the piston (6), metering and directing fuel from a fuel source to the combustion space (10) via a fuel metering system (50), operating an ignition device (91) for initiating ignition so as to initiate starting by a combustion in the combustion chamber.

26. The method as claimed in claim 25, wherein operating the setting drive (30) drives the piston (6) with a setting speed which is substantially smaller than the starting speed, of the piston (6), which is necessary for starting the internal combustion engine.

27. The method as claimed in claim 26, which comprises operating a control device (90) to cause the setting drive (30) to set the piston (6) in the favorable starting position (X) after the internal combustion engine is put out of operation and before starting the engine again.

28. The method as claimed in claim 25, which comprises operating a control device (90) to cause the setting drive (30) to set the piston (6) in the favorable starting position (X) after the internal combustion engine has been put out of operation and before starting the engine again.

29. The method as claimed in claim 28, which comprises directing a starting air from an air source to a mixing valve for mixing the air with said fuel to form a fuel-air mixture, and admitting the fuel-air mixture to the combustion space before initiating ignition.

* * * * *